US008028454B1

(12) United States Patent
Pontillo, II

(10) Patent No.: US 8,028,454 B1
(45) Date of Patent: Oct. 4, 2011

(54) LOADED CHAMBER INDICATOR SYSTEMS FOR SEMIAUTOMATIC HANDGUNS

(76) Inventor: James V. Pontillo, II, Anaheim, CA (US)

( * ) Notice: Subject to any disclaimer, the term of this patent is extended or adjusted under 35 U.S.C. 154(b) by 35 days.

(21) Appl. No.: 12/609,775

(22) Filed: Oct. 30, 2009

Related U.S. Application Data

(60) Provisional application No. 61/110,481, filed on Oct. 31, 2008.

(51) Int. Cl.
*F41A 9/53* (2006.01)

(52) U.S. Cl. ..... 42/1.05

(58) Field of Classification Search ..... 42/1.05, 42/1.01, 25, 46
See application file for complete search history.

(56) References Cited

U.S. PATENT DOCUMENTS

| | | | | |
|---|---|---|---|---|
| 2,145,328 | A * | 1/1939 | Fritz | 42/16 |
| 2,850,827 | A * | 9/1958 | Luciani | 42/1.05 |
| 3,561,396 | A * | 2/1971 | Luciani | 116/283 |
| 4,100,691 | A * | 7/1978 | Wicklund | 42/1.05 |
| 4,103,639 | A * | 8/1978 | Otteson | 42/1.05 |
| 4,615,132 | A | 10/1986 | Smith | |
| 4,726,136 | A | 2/1988 | Dornaus et al. | |
| 5,926,987 | A * | 7/1999 | Novak | 42/1.05 |
| 6,256,915 | B1 * | 7/2001 | da Silveira | 42/1.05 |
| 7,305,786 | B2 * | 12/2007 | McGarry | 42/1.05 |
| 7,383,655 | B2 * | 6/2008 | McGarry | 42/1.05 |
| 7,661,217 | B2 | 2/2010 | Pikielny | |
| 7,661,218 | B2 | 2/2010 | Pikielny | |
| 2005/0016048 | A1 * | 1/2005 | Fluhr | 42/1.05 |
| 2008/0028660 | A1 * | 2/2008 | Gussalli Beretta | 42/1.05 |

* cited by examiner

*Primary Examiner* — Michael Carone
*Assistant Examiner* — Reginald Tillman, Jr.
(74) *Attorney, Agent, or Firm* — Blakely Sokoloff Taylor & Zafman LLP

(57) ABSTRACT

Loaded chamber indicator systems semi-automatic handguns wherein a loaded chamber indicator is extended by the empty cartridge ejector when the empty cartridge ejector rests on a cartridge in the handgun chamber. In one embodiment, the loaded chamber indicator is in an opening or hole in the back of the slide, with the inner end of the loaded chamber indicator being enlarged and fitting within an inclined slot in the empty cartridge extractor so as to be extended or retracted dependent on whether the empty cartridge ejector rests on a cartridge in the handgun chamber. The empty cartridge extractor may be mostly molded plastic with a metal end for engaging cartridges, and the loaded chamber indicator may be entirely molded plastic. Multiple embodiments are disclosed.

17 Claims, 7 Drawing Sheets

LOADED CHAMBER INDICATOR SYSTEMS FOR SEMIAUTOMATIC HANDGUNS

CROSS-REFERENCE TO RELATED APPLICATION

This application claims the benefit of U.S. Provisional Patent Application No. 61/110,481 filed Oct. 31, 2008.

BACKGROUND OF THE INVENTION

1. Field of the Invention

The present invention relates to semiautomatic slide handguns (referred to herein as simply semiautomatic handguns).

2. Prior Art

New semiautomatic handguns must have what is referred to as a loaded chamber indicator. A loaded chamber indicator is a safety device. It is usually a small button that pops out to indicate the presence of a round in the chamber. By way of example, on the Beretta 90two, the loaded chamber indicator is a small red tab (extractor) that protrudes further from the slide when a round is in the chamber. The tab is located on the right side of the pistol's slide, near the cartridge chamber, and can be both seen and felt, allowing the user to check the chamber at night by feel or during the day by checking for the increased protrusion of the red tab.

On Glock semiautomatic handguns, the loaded chamber indicator also extends out the side of the slide when a cartridge is in the chamber. Commonly, the loaded chamber indicator of the prior art is a red button on the empty cartridge extractor, extending outward when the front of the extractor does not move substantially inward because of its encountering a casing of a loaded cartridge in the chamber.

DETAILED DESCRIPTION OF THE PREFERRED EMBODIMENT

Figure 1:
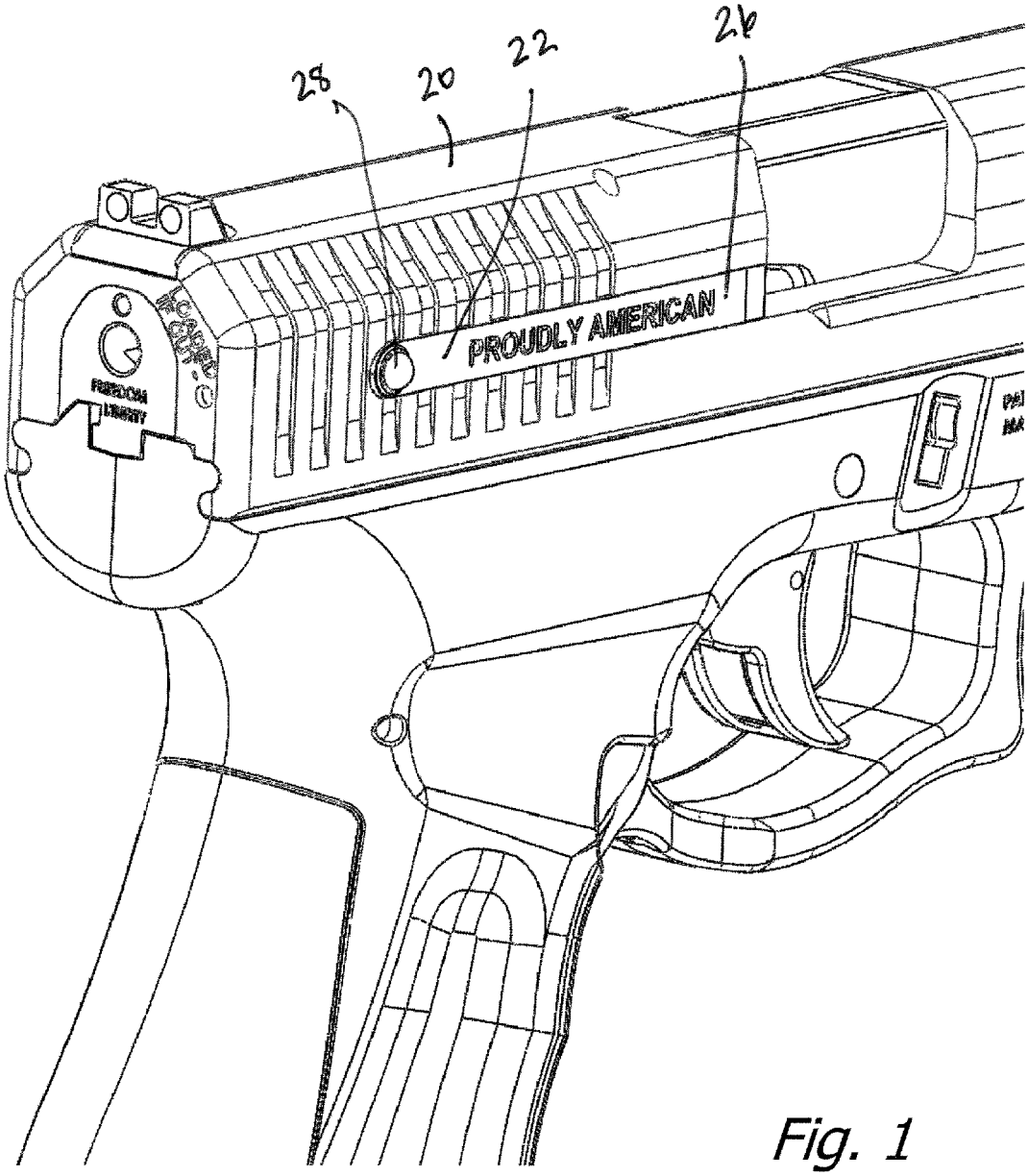
FIG. 1 illustrates the condition of the firearm with slide in the forward position, but with no cartridge in the chamber of one embodiment of the present invention.
Figure 2:
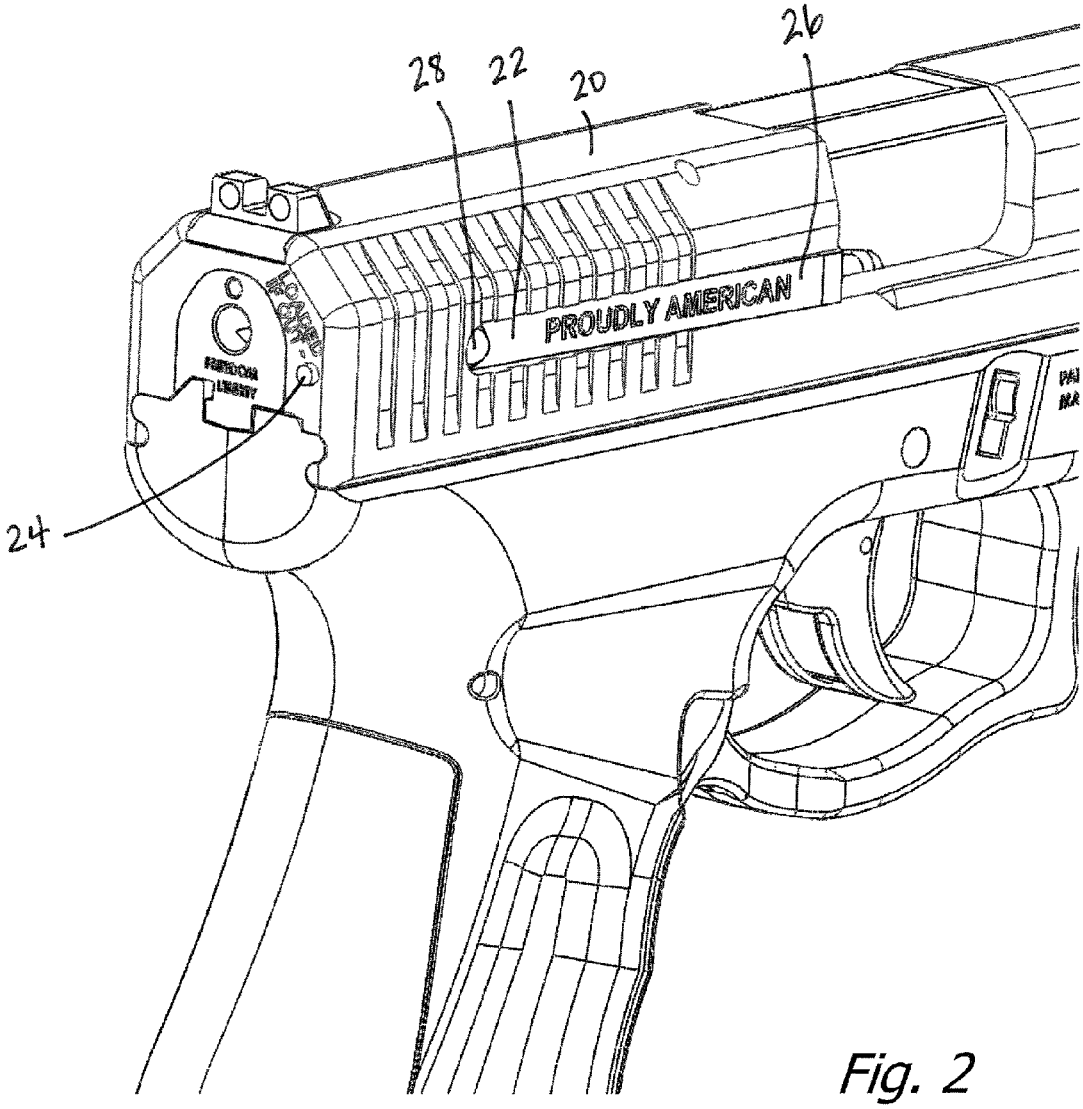
FIG. 2 illustrates the condition of the firearm with slide in the forward position and with a cartridge in the chamber.

First referring to FIGS. 1 and 2, a portion of a semi-automatic handgun incorporating the present invention may be seen. Of particular importance to the present invention is the slide 20 and extractor 22, as well as the loaded chamber indicator 24, the loaded chamber indicator 24 being visible in FIG. 2 but not in FIG. 1. FIG. 1 represents the condition of the firearm with slide 20 in the forward position but with no cartridge in the chamber. In this condition the outer surface of extractor 22 is flush with the slide 20, extending button 28 somewhat outward and withdrawing the loaded chamber indicator 24 into the back of the slide 20. In FIG. 2, the forward end 26 of the extractor 22 is projecting outward somewhat, caused by a cartridge in the chamber, moving button 28 inward and causing the loaded chamber indicator 24 to extend outward.

Figure 3:
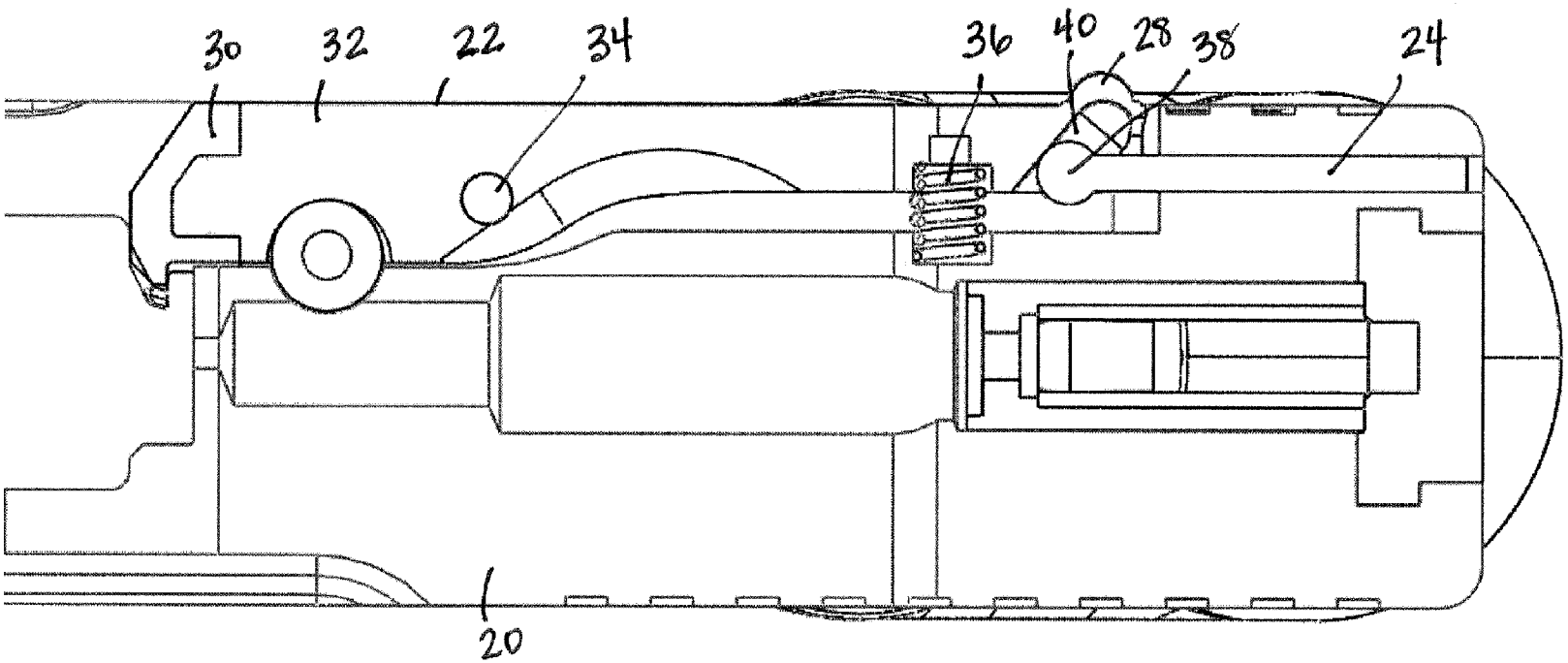
FIG. 3 is a cross-section taken through the center line of the barrel and firing pin when there is no cartridge in the chamber.
Figure 4:
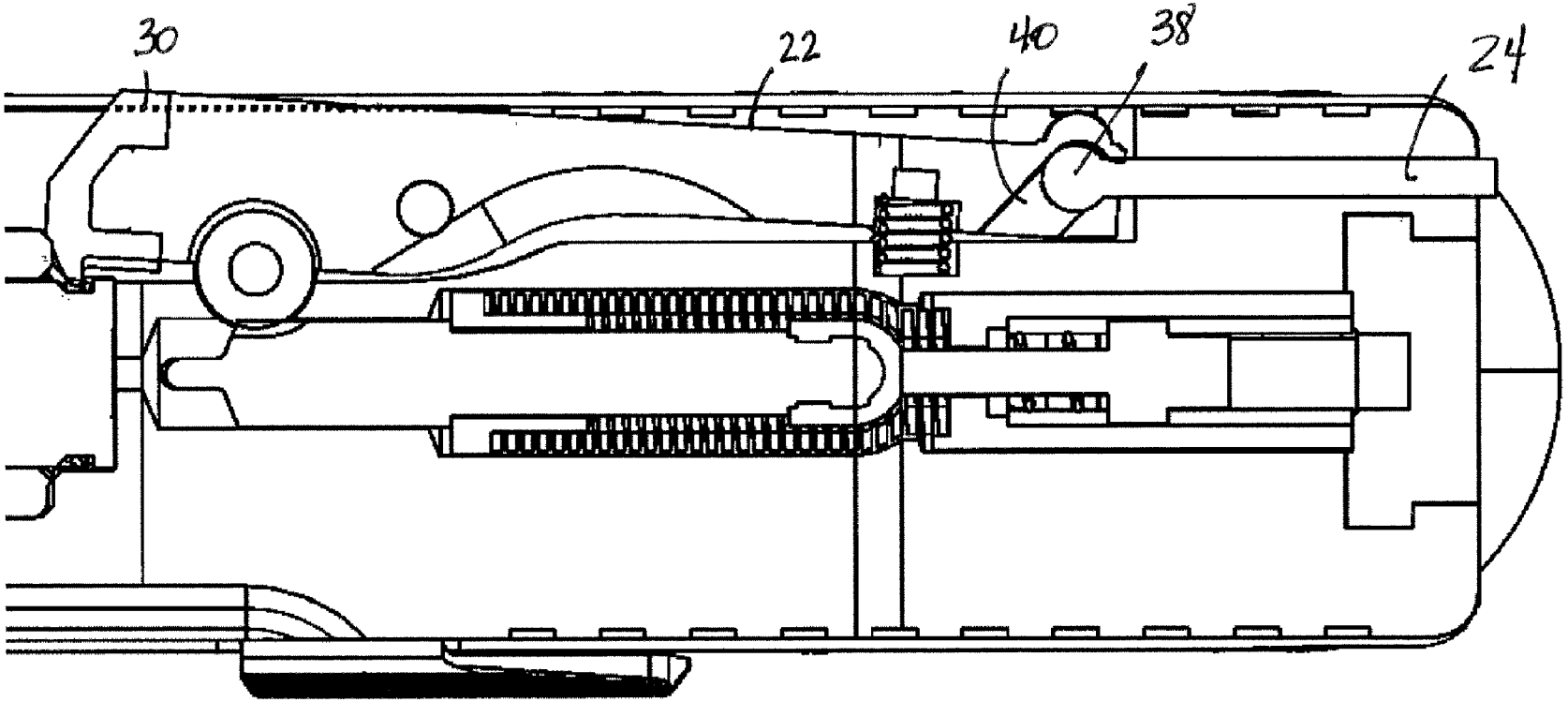
FIG. 4 is a cross-section similar to that of FIG. 3 and illustrating the position of the relevant parts when there is a cartridge in the chamber.

FIG. 3 is a cross-section taken through the center line of the barrel and firing pin when there is no cartridge in the chamber, and FIG. 4 is a similar cross-section illustrating the position of the relevant parts when there is a cartridge in the chamber. In one embodiment, the extractor 22 is all steel, though in another embodiment, rather than being all metal, the extractor 22 is comprised of two major pieces, specifically a metal extractor tip 30 and a molded plastic extractor body 32, the extractor being supported for rotation about pin 34 with respect to the slide 20. Coil spring 36 pushes the extractor 22 to the position shown in FIG. 3 with button 28 extending outward when there is no cartridge in the chamber. The loaded chamber indicator 24, in the preferred embodiment a red molded plastic member, has a ball type end 38 which rides in an inclined slot 40 in the end of the extractor 22. When the extractor 22 is in the position shown in FIG. 3 with no cartridge in the chamber, the ball 38 on the loaded cartridge pin 24 is at the lower part of slot 40, the slot acting as a cam which retracts the loaded chamber indicator 24 as shown in FIG. 3. However when there is a cartridge in the chamber, the extractor tip 30 will extend over the edge of the cartridge, tilting the extractor 22 as shown in FIG. 4, causing the ball 38 to ride up in slot 40 to push the other end of the loaded chamber indicator 24 outward past the end of the slide, as shown in both FIGS. 2 and 4.

Figure 5:
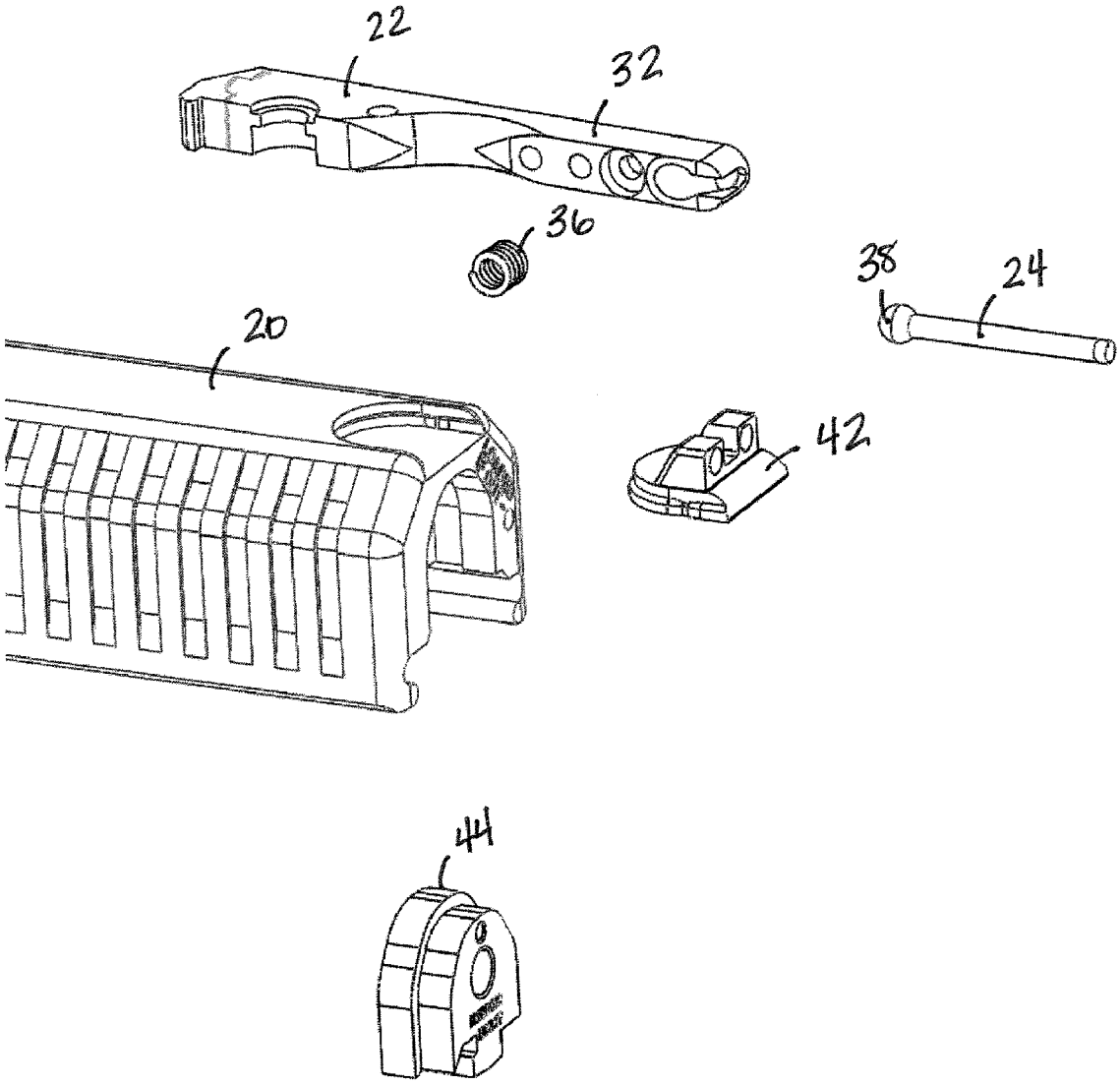
FIG. 5 illustrates the slide, extractor, loaded chamber indicator, sight and slide end cap of a preferred embodiment of the present invention.
Figure 6:
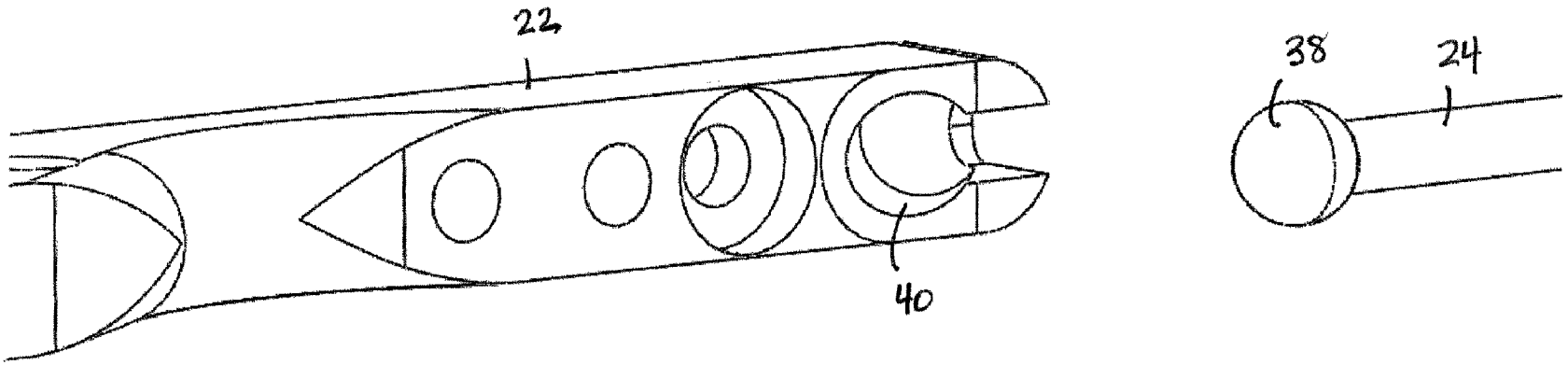
FIG. 6 illustrates the loaded chamber indicator and the loaded chamber indicator end of the extractor on an expanded scale.

Details of the extractor 22, particularly the end of the extractor which engages the ball 38 on the cartridge loaded indicator 24 may be seen in FIGS. 5 and 6. FIG. 5 shows the slide 20, extractor 22, loaded chamber indicator 24, sight 42 and slide end cap 44. The opening for receiving the shaft of the loaded chamber indicator 24 may be seen in the rear end of the slide in FIG. 2 with descriptive text, "loaded if out". In FIG. 6, the loaded chamber indicator 24 and the loaded chamber indicator end of the extractor 22 may be seen on an expanded scale. The inclined slot 4 is a cylindrical slot slightly larger in diameter than ball 38 on the end of the loaded chamber indicator 24, and angling as best seen in FIGS. 3 and 4. The adjacent end of the extractor 22 is slotted with a slot width adequate to provide clearance for the shaft of the loaded chamber indicator 24 and its relative movement when extending and retracting, but still substantially smaller than the diameter of ball 38 on the end of the loaded chamber indicator 24 to keep the ball within the inclined slot 4.

Figure 7:
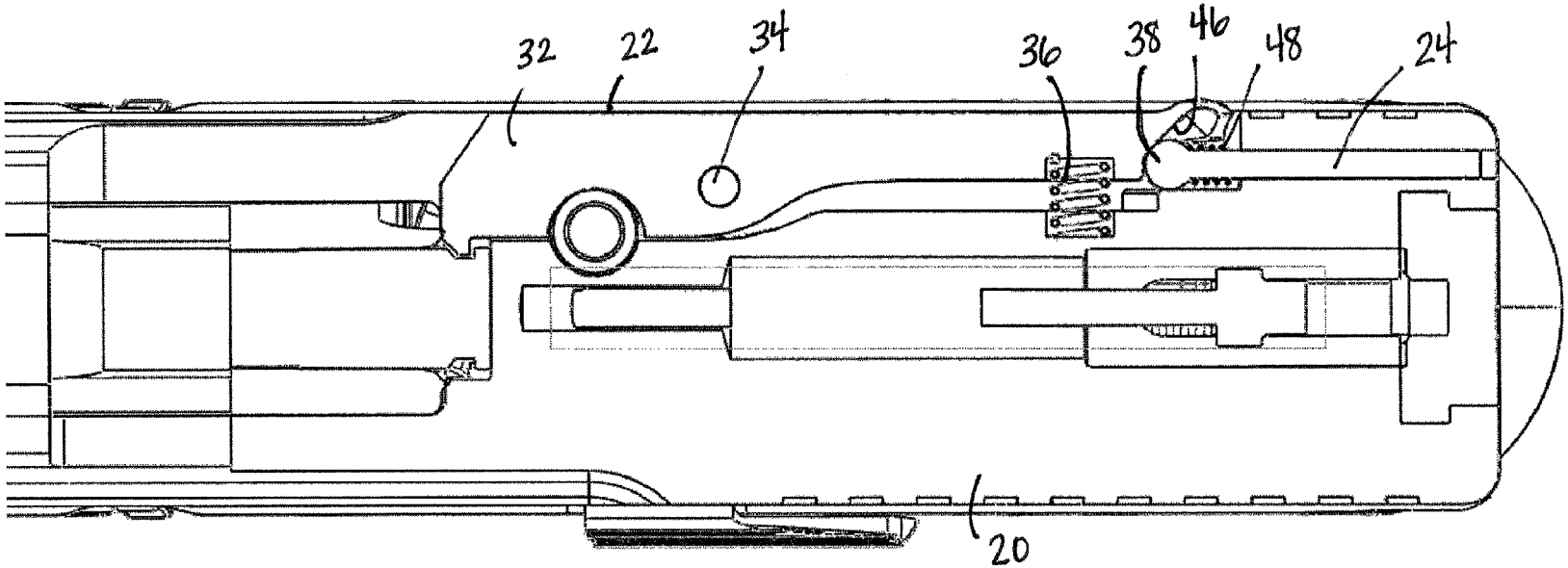
FIG. 7 is a cross-section taken through the center line of the barrel and firing pin when there is no cartridge in the chamber, similar to FIG. 3, but for an alternate embodiment.

As an alternate embodiment, the inclined or cam surface 46 on the loaded chamber indicator may be on a rear facing surface of empty cartridge extractor 22 so as to essentially be single acting, i.e., to extend the loaded chamber indicator 24 out of the rear of the slide when there is a cartridge in the chamber, with a coil spring 48 acting between the slide and ball or other cam surface on the loaded chamber indicator for its return as shown in FIG. 7, thus functioning as described for the first embodiment.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. In a slide type semiautomatic handgun, a loaded chamber indicator system for indicating the presence of a cartridge in the chamber comprising:

an empty cartridge extractor;

a loaded chamber indicator disposed in an opening in the slide;

the empty cartridge extractor having a cam surface thereon;

the loaded chamber indicator having a first end disposed against the cam surface on the empty cartridge extractor;

the cam surface being inclined to extend a second end opposite the first end of the loaded chamber indicator from the opening in the slide when the empty cartridge extractor is resting on a cartridge in the chamber.

2. The loaded chamber indicator system of claim 1 further comprising a spring disposed to hold the first end of the loaded chamber indicator against the cam surface.

3. The loaded chamber indicator system of claim 1 wherein:

the cam surface on the empty cartridge extractor is a slot therein;

the loaded chamber indicator has an enlarged first end disposed in the slot in the empty cartridge extractor;

the slot being inclined so that the loaded chamber indicator has a second end extending outward from the opening in the slide when the empty cartridge extractor is resting on a cartridge in the chamber, and for withdrawing the second end of the loaded chamber indicator into the opening in the slide when the empty cartridge extractor is not resting on a cartridge in the chamber.

4. The loaded chamber indicator system of claim 1 wherein the opening in the slide is at a back of the slide.

5. The loaded chamber indicator system of claim 3 wherein the empty cartridge extractor is supported for rotation about a pin, and has a first end at one side of the pin for engaging a cartridge in the chamber and a second end at a second side of the pin having the slot therein.

6. The loaded chamber indicator system of claim 5 wherein the first end of the empty cartridge extractor is metal and the rest of the empty cartridge extractor is plastic.

7. The loaded chamber indicator system of claim 1 wherein the loaded chamber indicator is plastic.

8. In a slide type semiautomatic handgun, a loaded chamber indicator system for indicating the presence of a cartridge in the chamber comprising:

an empty cartridge extractor supported by the slide on a pin for rotation about a vertical axis, the empty cartridge extractor having a first end forward of the pin for engaging a cartridge in the chamber and a second end behind the pin having a first slot therein, the first slot having a horizontal axis;

a loaded chamber indicator disposed in an opening at a back of the slide;

the loaded chamber indicator having an enlarged first end disposed in the first slot in the empty cartridge extractor;

the first slot being inclined so that the loaded chamber indicator has a second end extending outward from the opening in the slide when the empty cartridge extractor is resting on a cartridge in the chamber, and for withdrawing the second end of the loaded chamber indicator into the opening at the back of the slide when the empty cartridge extractor is not resting on a cartridge in the chamber.

9. The loaded chamber indicator system of claim 8 wherein the first end of the empty cartridge extractor is metal and the rest of the empty cartridge extractor is plastic.

10. The loaded chamber indicator system of claim 9 wherein the loaded chamber indicator is plastic.

11. The loaded chamber indicator system of claim 10 wherein the loaded chamber indicator is plastic having the shape of a cylindrical rod with a ball on the first end thereof, the ball fitting within the first slot, the empty cartridge extractor having a second slot extending from its second end to the first slot, the second slot being smaller than the first slot and the ball on the first end of the loaded chamber indicator, but larger than the cylindrical rod of the loaded chamber indicator.

12. The loaded chamber indicator system of claim 8 wherein the loaded chamber indicator is plastic.

13. The loaded chamber indicator system of claim 12 wherein the loaded chamber indicator is plastic having the shape of a cylindrical rod with a ball on a first end thereof, the ball fitting within the first slot, the empty cartridge extractor having a second slot extending from its second end to the first slot, the second slot being smaller than the first slot and the ball on the first end of the loaded chamber indicator, but larger than the cylindrical rod of the loaded chamber indicator.

14. In a slide type semiautomatic handgun, a loaded chamber indicator system for indicating the presence of a cartridge in the chamber comprising:

an empty cartridge extractor supported by the slide on a pin for rotation about a vertical axis, the empty cartridge extractor having a first end forward of the pin for engaging a cartridge in the chamber and a second end behind the pin having a first slot therein, the first slot having a horizontal axis;

a loaded chamber indicator disposed in an opening at a back of the slide;

the loaded chamber indicator having an enlarged first end disposed against a cam surface in the empty cartridge extractor;

a spring acting against the enlarged first end of the loaded chamber indicator to hold the enlarged first end against the cam surface;

the cam surface being inclined so that the loaded chamber indicator has a second end extending outward from the opening in the slide when the empty cartridge extractor is resting on a cartridge in the chamber, and for withdrawing the second end of the loaded chamber indicator into the opening at the back of the slide when the empty cartridge extractor is not resting on a cartridge in the chamber.

15. The loaded chamber indicator system of claim 14 wherein the first end of the empty cartridge extractor is metal and the rest of the empty cartridge extractor is plastic.

16. The loaded chamber indicator system of claim 15 wherein the loaded chamber indicator is plastic.

17. In a semiautomatic handgun having a slide and an empty cartridge extractor, a method for indicating the presence of a cartridge in the chamber comprising:

providing an inclined cam surface on empty cartridge extractor;

providing a loaded chamber indicator disposed in an opening in the slide with one end of the loaded chamber indicator adjacent the cam surface;

the cam surface being inclined to extend a second end of the loaded chamber indicator from the opening in the slide when the empty cartridge extractor is resting on a cartridge in the chamber.

* * * * *